US008275281B2

(12) United States Patent
Asaka

(10) Patent No.: US 8,275,281 B2
(45) Date of Patent: Sep. 25, 2012

(54) IMAGE FORMING APPARATUS AND IMAGE FORMING SYSTEM

(75) Inventor: Hitoshi Asaka, Osaka (JP)

(73) Assignee: Kyocera Mita Corporation (JP)

( * ) Notice: Subject to any disclaimer, the term of this patent is extended or adjusted under 35 U.S.C. 154(b) by 349 days.

(21) Appl. No.: 12/613,796

(22) Filed: Nov. 6, 2009

(65) Prior Publication Data

US 2010/0119249 A1 May 13, 2010

(30) Foreign Application Priority Data

Nov. 12, 2008 (JP) ..... 2008-289953

(51) Int. Cl.
*G03G 21/02* (2006.01)
*G03G 15/00* (2006.01)

(52) U.S. Cl. ..... 399/79; 399/81; 399/88

(58) Field of Classification Search ..... 399/70, 399/79, 80, 81, 88
See application file for complete search history.

(56) References Cited

U.S. PATENT DOCUMENTS

| | | | | |
|---|---|---|---|---|
| 5,920,749 | A * | 7/1999 | Sugaya et al. | 399/69 |
| 7,171,135 | B2 * | 1/2007 | Nishizawa et al. | 399/70 |
| 2003/0053111 | A1 | 3/2003 | Endo | |

FOREIGN PATENT DOCUMENTS

| | | |
|---|---|---|
| JP | 2002-55567 | 2/2002 |
| JP | 2003-195986 | 7/2003 |
| JP | 2005215568 | 8/2005 |

* cited by examiner

*Primary Examiner* — David Gray
*Assistant Examiner* — Erika J Villaluna
(74) *Attorney, Agent, or Firm* — Gerald E. Hespos; Michael J. Porco

(57) ABSTRACT

An image forming apparatus comprises a connection unit, a display unit, a detector unit detecting the connection of the vendor to the connection unit and detecting the receipt of at least either one of card insertion and coin insertion by the vendor, a fixing unit, a power supply unit distributing power to the display unit and the fixing unit, and a control unit causing the power supply unit to distribute power to the fixing unit so that the fixing unit maintains a second standby temperature lower than a first standby temperature being lower than a toner image heating temperature while causing the power supply unit to maintain the power distribution to the display unit when the detector unit does not detect the receipt of at least either one of the card insertion and the coin insertion by the vendor while detecting the connection of the vendor to the connection unit.

13 Claims, 6 Drawing Sheets

IMAGE FORMING APPARATUS AND IMAGE FORMING SYSTEM

BACKGROUND OF THE INVENTION

1. Field of the Invention

The present invention relates to an image forming apparatus and an image forming system.

2. Description of the Related Art

Image forming apparatuses for forming images such as complex machines, copiers and printers are installed in shops such as convenience stores. In such shops, a service (e.g. copy service) enabling customers to use the image forming apparatus is provided. A vendor for receiving either one of card insertion and coin insertion is connected to an image forming apparatus of this type via a signal line.

Generally, the image forming apparatus used by being connected to the vendor enters a state where a specified job such as a print job can be performed when the vendor receives either one of the insertion of a card possessed by a user and the coin insertion. When the specified job using the image forming apparatus is finished or the card or coins are returned, the service using the image forming apparatus is finished and the image forming apparatus enters an unusable state.

From the viewpoint of energy saving, an electronic device has been provided which has a function of executing an energy save mode to reduce power consumption when the unused state continues. The electronic device of this type stops power distribution to all the elements except element(s) minimum necessary to cancel the energy save mode.

If the image forming apparatus used by being connected to the vendor automatically executes the energy save mode when the image forming apparatus is in the unused state, the following problem occurs. While the energy save mode is not executed, the image forming apparatus displays a message screen such as "INSERT A CARD" or "INSERT COINS" on a display panel to request a customer to insert either one of a card or coins into the vendor.

However, when the energy save mode is executed, the image forming apparatus stops power distribution to all the elements except the element(s) minimum necessary to cancel the energy save mode. Thus, power distribution to the display panel is stopped and the message screen as described above is not displayed to customers.

As a result, in the unused state of the image forming apparatus, customers cannot see the message screen and does not know that he is requested to insert either a card or coins into the vendor. Thus, in some cases, it cannot be known whether or not the image forming apparatus is in a usable state. In such cases, customers have to make cumbersome inquiries to a shop clerk or the like, leading to a reduction in the quality of the service.

In the following description, "the usable state of the image forming apparatus" means a state where the service using the image forming apparatus can be used."

SUMMARY OF THE INVENTION

An object of the present invention is to provide an image forming apparatus and an image forming system connectable to a vendor and capable of energy saving with power distribution to a display unit maintained while the image forming apparatus is not used.

In order to accomplish the above object, one aspect of the present invention is directed to an image forming apparatus, comprising a connection unit for outputting a connection notification signal notifying the connection of a vendor when the vendor for outputting a reception signal indicating the receipt of at least either one of the insertion of a card recorded with usage information for the use of the image forming apparatus and coin insertion is connected; a display unit; a detector unit for detecting the connection of the vendor to the connection unit upon receiving the connection notification signal output from the connection unit and detecting the receipt of at least either one of the card insertion and the coin insertion by the vendor upon receiving the reception signal output from the vendor via the connection unit; a fixing unit adapted to fix a toner image formed on a recording sheet by heating and pressing the toner image and capable of maintaining at least a toner image heating temperature at which the toner image is heated and a first standby temperature lower than the toner image heating temperature; a power supply unit for distributing power to the display unit and the fixing unit; and a control unit for causing the power supply unit to apply power to the display unit and the fixing unit, wherein the control unit causes the power supply unit to apply power to the fixing unit so that the fixing unit maintains a second standby temperature lower than the first standby temperature while causing the power supply unit to maintain the power distribution to the display unit when the detector unit does not detect the receipt of at least either one of the card insertion and the coin insertion by the vendor while detecting the connection of the vendor to the connection unit.

DETAILED DESCRIPTION OF THE PREFERRED EMBODIMENTS

Figure 1:
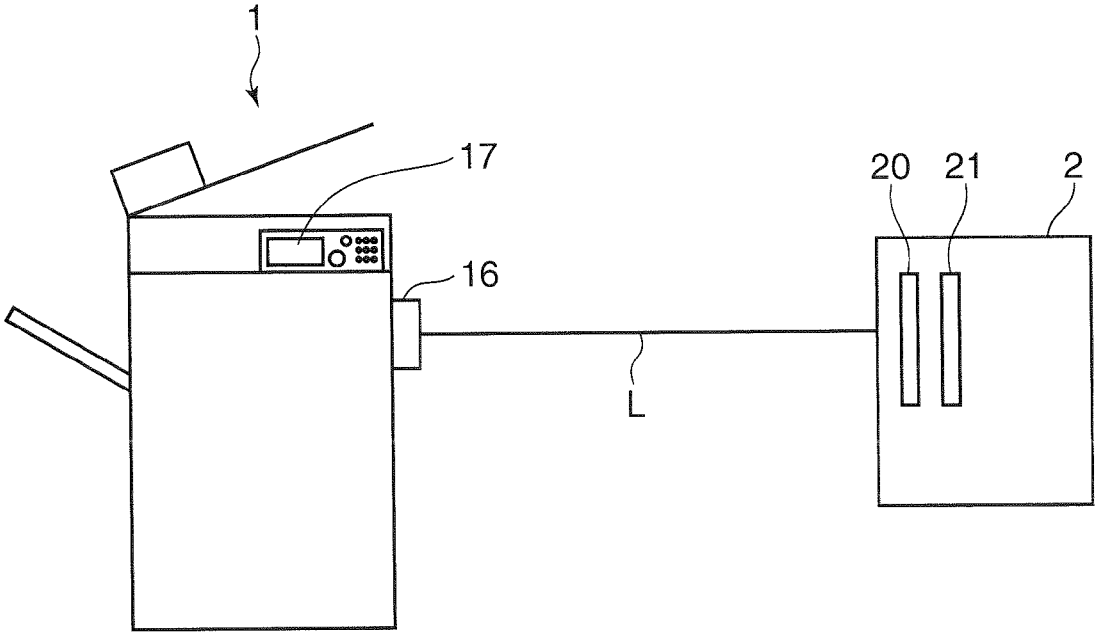
FIG. 1 is an external view schematically showing an exemplary image forming system according to one embodiment of the invention.
Figure 2:
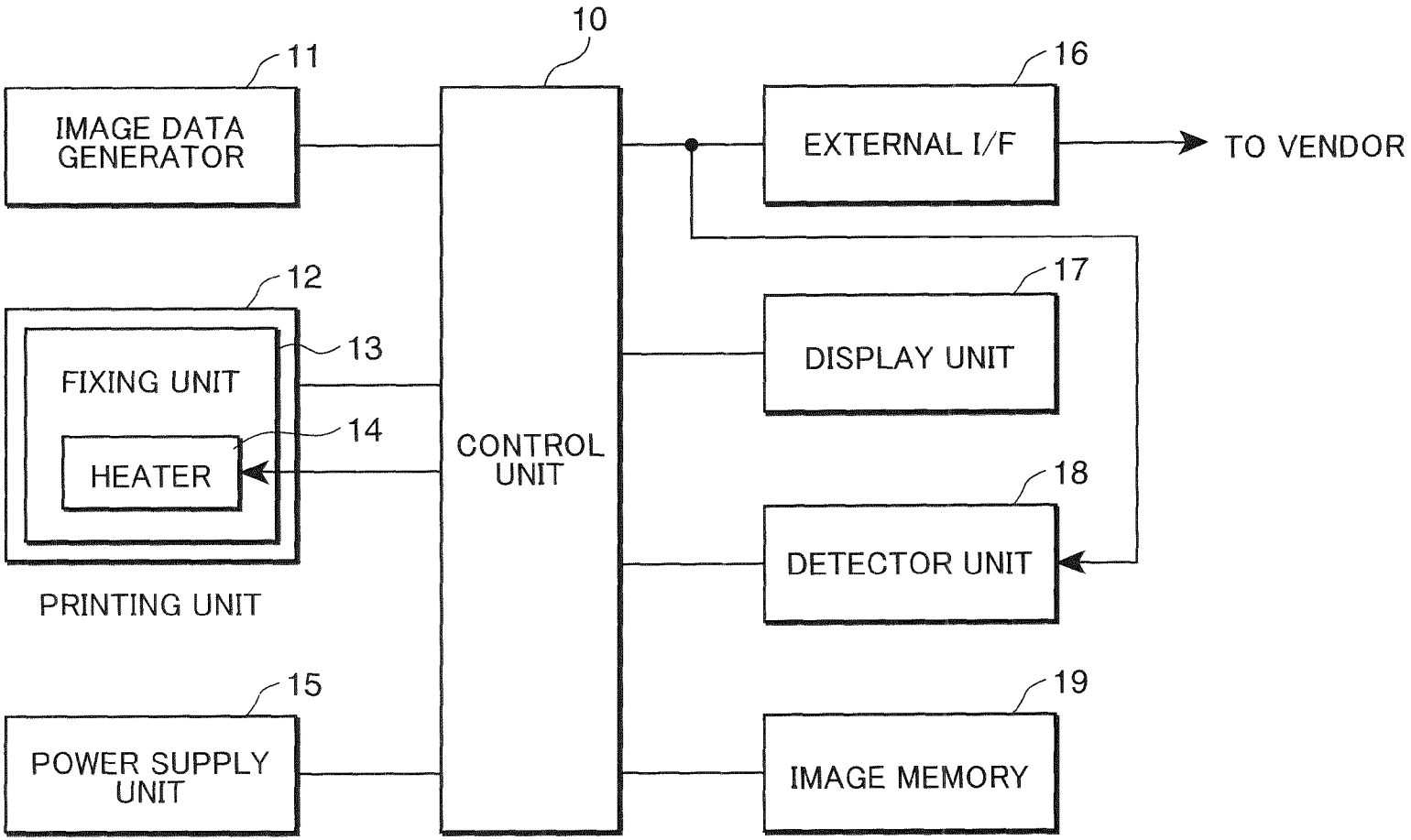
FIG. 2 is a block diagram showing an exemplary functional construction of an image forming apparatus according to one embodiment of the invention.

Hereinafter, an image forming apparatus and an image forming system according to one embodiment of the present invention are described. FIG. 1 is an external view schematically showing an exemplary image forming system according to one embodiment of the invention. FIG. 2 is a block diagram showing an exemplary functional construction of an image forming apparatus according to one embodiment of the invention.

In the image forming system shown in FIG. 1, a vendor 2 is connected to an external I/F (interface) (connection unit) 16 of an image forming apparatus 1 via a signal line capable of bi-directional communication. Here, the signal line L is, for example, a serial cable or a parallel cable. The vendor 2 includes a coin insertion slot 20 and a card insertion slot 21.

When coins are inserted into the coin insertion slot 20 or a card is inserted into the card insertion slot 21, the vendor 2 outputs a reception signal indicating the reception of either one of card insertion or coin insertion. This reception signal is a signal which is kept output, for example, for a period during which the card is inserted in the card insertion slot 21, i.e. for a period from the insertion of the card into the card insertion slot 21 to the ejection of the card from the card insertion slot 21. Further, the reception signal is a signal which is kept output, for example, for a period during which the coins inserted into the coin insertion slot 20 can be returned (for example, a period from the insertion of the coins into the coin insertion slot 20 to the finish of a job by the image forming apparatus 1 or a period from the insertion of the coil into the coin insertion slot 20 to the operation of an unillustrated return button). The vendor 2 may include only the coin insertion slot 20 or the card insertion slot 21.

Here, coins to be inserted into the coin insertion slot 20 are, for example, 10-yen coins, 50-yen coins, 100-yen coins and 500-yen coins. Cards to be inserted into the card insertion slot 21 are cards recorded with usage information for the use of the image forming apparatus 1 and, for example, special cards recorded with remaining points, cash cards or credit cards recorded with personal identification numbers.

On the other hand, the external I/F 16 regularly outputs an inquiry signal inquiring whether or not the vendor 2 is connected with the signal line L and receives a return signal from the vendor when the vendor 2 is connected. At this time, the external I/F 16 outputs a connection notification signal notifying the connection of the vendor 2.

The image forming apparatus 1 shown in FIG. 2 is provided with a control unit 10, an image data generator 11, a printing unit 12, a power supply unit 15, the external I/F 16, a display unit 17, a detector unit 18 and an image memory 19.

In such an image forming apparatus 1, the control unit 10 controls the image forming apparatus 1 by transferring control signals and data via a control bus (e.g. CPU bus) and a data bus. The control unit 10 performs a power distribution control process to be described later.

Particularly, the control unit 10 controls power distribution by the power supply unit 15 so that the temperature of a fixing unit 13 is maintained at any one of a toner image heating temperature, a first standby temperature and a second standby temperature to be described later. Here, a power distribution control method is, for example, to reduce the amount of power distributed to a heater 14 or to increase an interval of power distribution to the heater 14.

The image data generator 11 generates image data by scanning a document placed on a platen (not shown).

The printing unit 12 forms a toner image representing image data on a preset recording sheet and then fixes the toner image formed on the recording sheet by heating and pressing the toner image. Such a printing unit 12 includes the fixing unit 13. The fixing unit 13 is, for example, composed of unillustrated fixing roller and pressure roller. The fixing unit 13 includes the heater 14 for heating the fixing roller.

Here, if the fixing unit 13 includes the fixing roller, the heater 14 is built in the fixing roller. The power distribution to the heater 14 is controlled by the control unit 10. In other words, the heater 14 is heated upon receiving the supply of power form the power supply unit 15. This heating control is performed through the power distribution control by the control unit 10.

The power supply unit 15 generates a driving power supply of the image forming apparatus 1 upon receiving the supply from an unillustrated alternating-current source. The power supply unit 15, for example, distributes power to the fixing unit 13 and the display unit 17 by generating driving power supplies of the fixing unit 13 and the display unit 17.

As described above, the external I/F 16 regularly outputs an inquiry signal inquiring whether or not the vendor 2 is connected with the signal line L. The external I/F 16 receives a return signal from the vendor 2 and outputs a connection notification signal notifying the connection of the vendor 2 to the detector unit 18 when the vendor 2 is connected. Further, the external I/F 16 receives the reception signal output from the vendor 2 and outputs it to the detector unit 18. The display unit 17 displays various screens on the unillustrated display panel.

The detector unit 18 detects the connection of the vendor 2 to the external I/F 16 upon the receipt of the connection notification signal. The detector unit 18 also receives the reception signal output from the vendor 2 via the external I/F 16 to detect that the vendor 2 received at least either one of card insertion and coin insertion.

The detector unit 18 outputs signals notifying the respective detections to the control unit 10 upon detecting the connection of the vendor 2 to the external I/F 16 and the receipt of at least either one of card insertion and coin insertion by the vendor 2. The image memory 19 stores the image data generated by the image data generator 11.

The basic operation of such an image forming apparatus 1 is as follows. Specifically, image data generated by the image data generator 11 are successively stored in the image memory 19, and the image data stored in the image memory 19 are successively read. Then, in the printing unit 12, a toner image representing the image data is formed on a preset recording sheet and then the toner image formed on the recording sheet is fixed to the recording sheet by heating and pressing the toner image. The temperature of the fixing unit 13 at this time is a toner image heating temperature at which the toner image formed on the recording sheet is heated.

Figure 3:
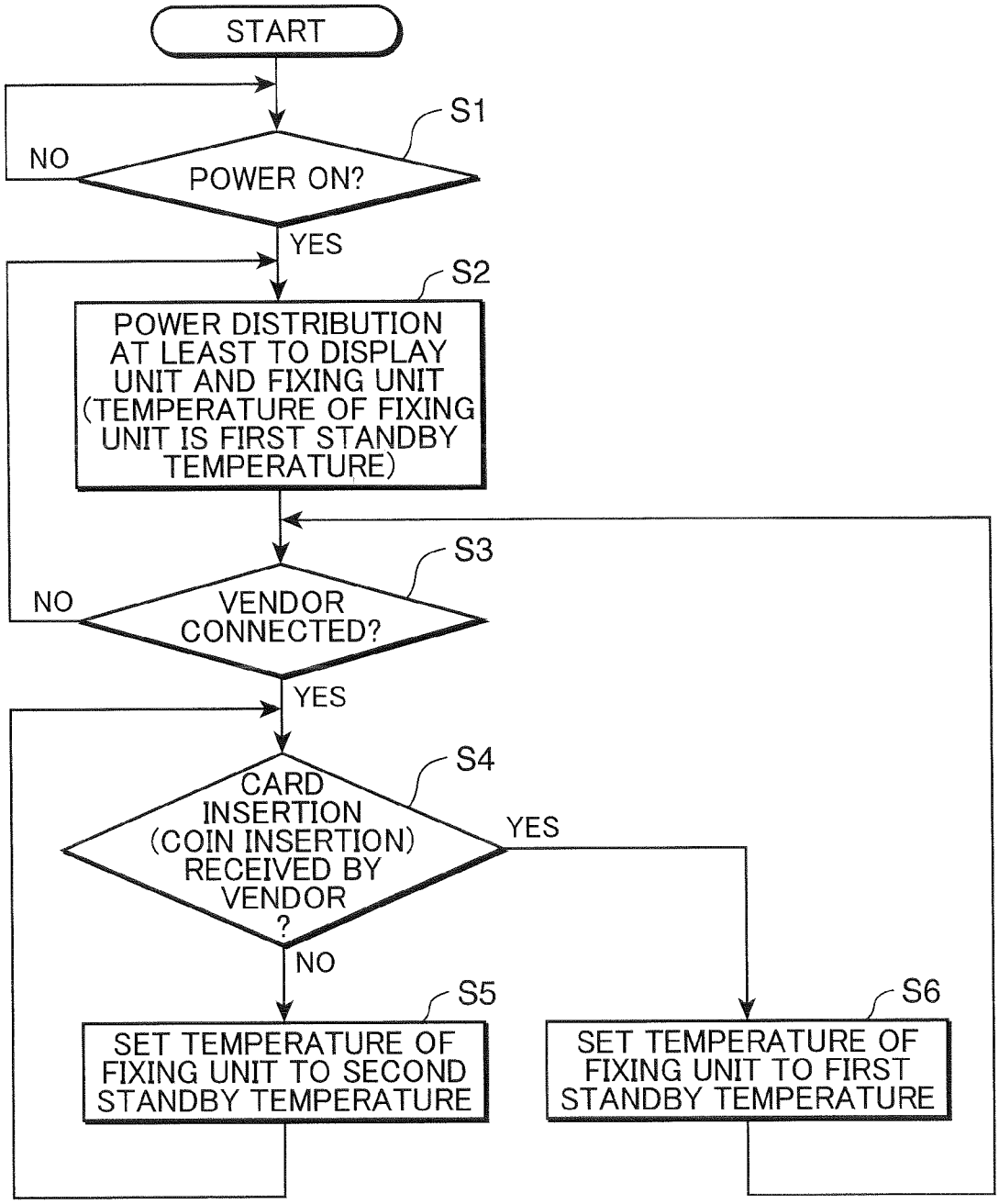
FIG. 3 is a flow chart showing an exemplary summary of a power distribution control process performed in the image forming apparatus.

FIG. 3 is a flow chart showing an exemplary summary of the power distribution control process performed in the image forming apparatus 1. Although the receipt of the card insertion by the vendor 2 is illustrated here, a similar process is performed also when the vendor receives the coin insertion.

When an unillustrated power switch is turned on in the image forming apparatus 1 (YES in Step S1), the control unit 10 causes the power supply unit 15 to start power distribution at least to the display unit 17 and the fixing unit 13 (Step S2: first power distribution control step). At this time, the control unit 10 causes the power supply unit 15 to distribute power to the heater 14 so that the fixing unit 13 is maintained at the first standby temperature lower than the toner image heating temperature.

Subsequently, the control unit 10 judges whether or not the detector unit 18 has detected the connection of the vendor 2 to the external I/F 16 (Step S3: first judgment step). The control unit 10 successively judges whether or not the detector unit 18 has detected the receipt of the card insertion (coin insertion) by the vendor 2 (Step S4: second judgment step) if the connection of the vendor 2 to the external I/F 16 is detected by the detector unit 18 (YES in Step S3).

On the other hand, the control unit 10 proceeds to the process shown in Step S2 to maintain the power distributing state to the display unit 17 and the fixing unit 13 by the power supply unit 15 unless the detector unit 18 has detected the connection of the vendor 2 to the external I/F 16 (NO in Step S3). At this time, the temperature of the fixing unit 13 is the first standby temperature.

In Step S4, the control unit 10 causes the power supply unit 15 to distribute power to the heater 14 so that the fixing unit 13 is maintained at the second standby temperature lower than the first standby temperature (Step S5: second power distribution control step) unless the detector unit 18 has detected the receipt of the card insertion (coin insertion) by the vendor 2 (NO in Step S4). At this time, the control unit 10 maintains the power distributing state to the display unit 17 by the power supply unit 15.

The control unit 10 returns to the process shown in Step S4 and waits on standby until the detector unit 18 detects the receipt of the card insertion (coin insertion) after the temperature of the fixing unit 13 is set to the second standby temperature in the process shown in Step S5. If the detector unit 18 detects the receipt of the card insertion (coin insertion) by the vendor 2 (YES in Step S4), the control unit 10 causes the power supply unit 15 to distribute power to the heater 14 so that the fixing unit 13 is maintained at the first standby temperature (Step S6).

As described above, the image forming apparatus 1 sets the temperature of the fixing unit 13 to the second standby temperature lower than the first standby temperature while maintaining the power distribution to the display unit 17 if no card has been inserted (no coins have been inserted) into the vendor 2 with the vendor 2 connected to the image forming apparatus 1. Thus, the image forming apparatus 1 can inform customers of the usable state (state where the service using the image forming apparatus 1 can be used) and can save energy while the image forming apparatus 1 is not used (while neither the card insertion nor the coin insertion is made to the vendor 2).

Figure 4:
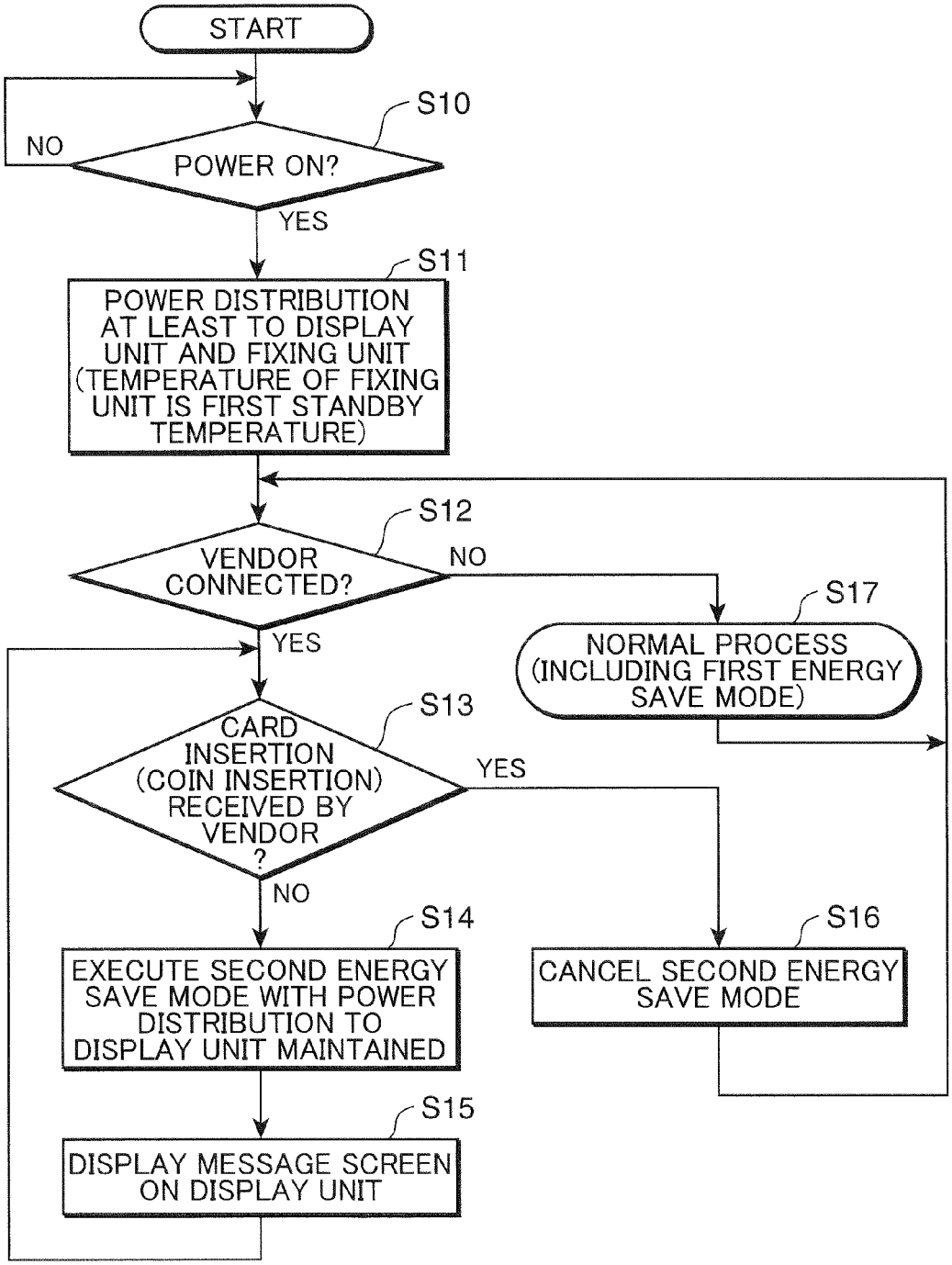
FIG. 4 is a flow chart showing another exemplary summary of the power distribution control process performed in the image forming apparatus.
Figure 5:
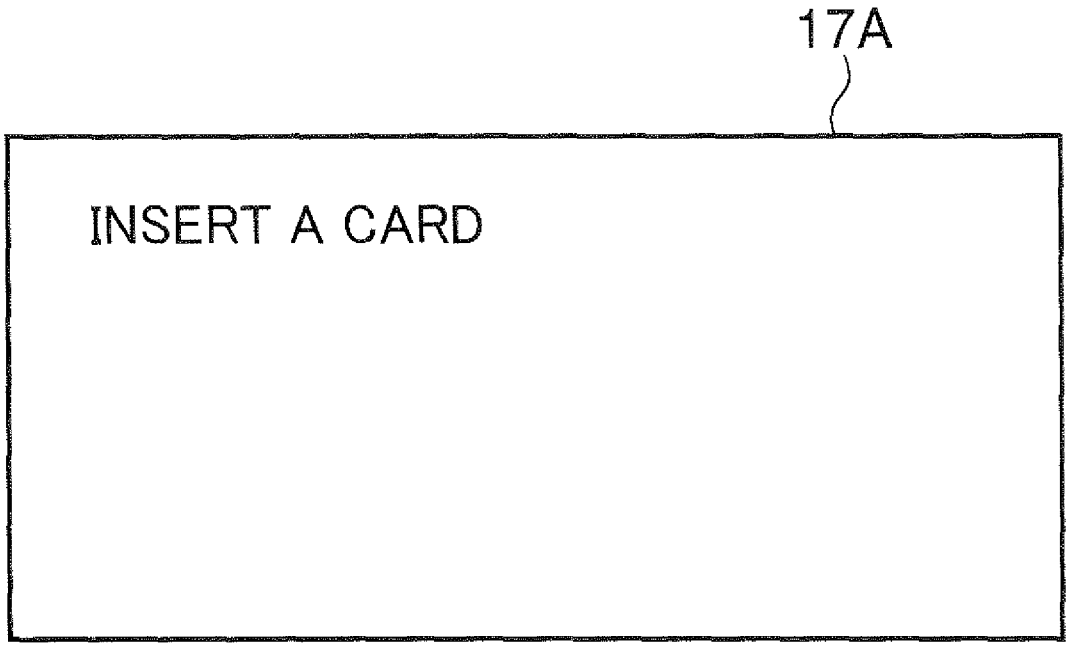
FIG. 5 is a diagram showing an exemplary message screen displayed on a display unit.
Figure 6:
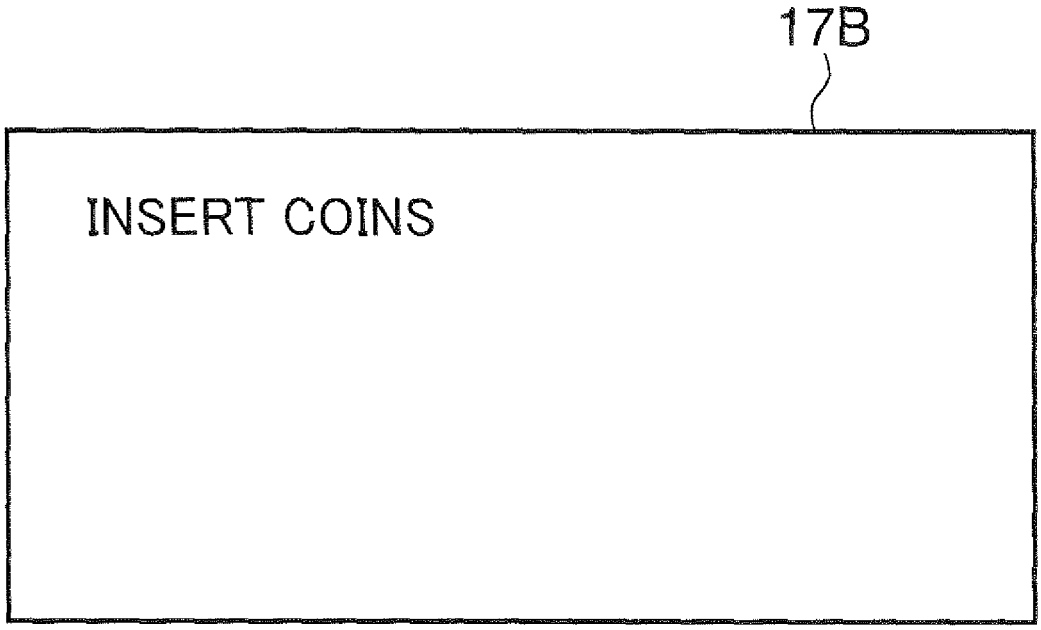
FIG. 6 is a diagram showing another exemplary message screen displayed on the display unit.

FIG. 4 is a flow chart showing another exemplary summary of the power distribution control process performed in the image forming apparatus 1. Although the receipt of the card insertion by the vendor 2 is illustrated here, a similar process is performed also when the vendor receives the insertion of coins. FIG. 5 is a diagram showing an exemplary message screen displayed on the display unit 17. FIG. 6 is a diagram showing another exemplary message screen displayed on the display unit 17.

When the unillustrated power switch is turned on in the image forming apparatus 1 (YES in Step S10), the control unit 10 causes the power supply unit 15 to start power distribution at least to the display unit 17 and the fixing unit 13 (Step S11: first power distribution control step). At this time, the control unit 10 causes the power supply unit 15 to distribute power to the heater 14 so that the fixing unit 13 is maintained at the first standby temperature lower than the toner image heating temperature.

Subsequently, the control unit 10 judges whether or not the detector unit 18 has detected the connection of the vendor 2 to the external I/F 16 (Step S12: first judgment step). The control unit 10 successively judges whether or not the detector unit 18 has detected the receipt of the card insertion (coin insertion) by the vendor 2 (Step S13: second judgment step) if the connection of the vendor 2 to the external I/F 16 is detected by the detector unit 18 (YES in Step S12).

On the other hand, the control unit 10 performs a normal process (Step S17) unless the detector unit 18 has detected the connection of the vendor 2 to the external I/F 16 (NO in Step S12).

Here, the normal process includes, for example, a process for executing a normal energy save mode (first energy save mode) and a process for returning from the normal energy save mode. The process for executing the normal energy save mode is a process for cutting off power distribution at least to the display unit 17 and the fixing unit 13 or executing the normal energy save mode for reducing the amounts of power distributed at least to the display unit 17 and the fixing unit 13 unless an unillustrated operation key is operated even upon the lapse of a specified time after the power switch is turned on or a job is finished.

The process for returning from the normal energy save mode is a process for distributing power at least to the display unit 17 and the fixing unit 13 or restoring the amounts of power distributed at least to the display unit 17 and the fixing unit 13 to levels before a reduction when the unillustrated operation key is operated in the normal energy save mode.

The control unit 10 executes a second energy save mode for maintaining the power distribution to the display unit 17 and cutting off or reducing the power distribution to the other elements in the image forming apparatus 1 (Step S14: second power distribution control step) unless the detector unit 18 has detected the receipt of the card insertion (coin insertion) by the vendor 2 (NO in Step S13). In this case, the execution of the first energy save mode itself may be prohibited.

Subsequently, the control unit 10 causes the display unit 17 to display a message screen 17A (see FIG. 5) saying, for example, "INSERT A CARD", thereby requesting a customer to insert a card into the vendor 2 (Step S15). The control unit 10 may also cause the display unit 17 to display a message screen 17B saying "INSERT COINS" as shown in FIG. 6, thereby requesting the customer to insert coins into the vendor 2.

The control unit 10 executes the second energy save mode for maintaining the power distribution to the display unit 17 and cutting off or reducing the power distribution to the other elements in the image forming apparatus 1, proceeds to a process shown in Step S13 with the message screen 17A kept displayed on the display unit 17 and waits on standby until the detector unit 18 detects the receipt of the card insertion (coin insertion) by the vendor 2.

Since the message screen 17A or 17B is displayed during the execution of the second energy save mode in this way, the customer can understand that the card insertion (coin insertion) is requested. Thus, upon providing a copy service necessitating the use of the image forming apparatus 1 and used by a large indefinite number of people, customers can tell at a glance that the image forming apparatus 1 is in the usable state.

The control unit 10 cancels the second energy save mode to restore the power distributing states to the elements other than the display unit 17 (Step S16) when the detector unit 18 detects the receipt of the card insertion (coin insertion) by the vendor 2 (YES in Step S13). In other words, power is distributed to the elements in the image forming apparatus 1 other than the display unit 17 again or the amounts of power distributed to the elements in the image forming apparatus 1 other than the display unit 17 are restored to the levels before the reduction.

The control unit 10 returns the temperature of the fixing unit 13 to the first standby temperature by performing the process shown in Step S16.

As described above, the second energy save mode for maintaining the power distribution to the display unit 17 is executed when the image forming apparatus 1 is connected to the vendor 2 and no card is inserted (no coins are inserted) into the vendor 2. Thus, the image forming apparatus 1 can inform customers of the usable state and can save energy while the image forming apparatus 1 is not used.

The above specific embodiment mainly embraces inventions having the following constructions.

An image forming apparatus according to one aspect of the present invention comprises a connection unit for outputting a connection notification signal notifying the connection of a vendor when the vendor for outputting a reception signal indicating the receipt of at least either one of the insertion of a card recorded with usage information for the use of the image forming apparatus and coin insertion is connected; a display unit; a detector unit for detecting the connection of the vendor to the connection unit upon receiving the connection notification signal output from the connection unit and detecting the receipt of at least either one of the card insertion and the coin insertion by the vendor upon receiving the reception signal output from the vendor via the connection unit; a fixing unit adapted to fix a toner image formed on a recording sheet by heating and pressing the toner image and capable of maintaining at least a toner image heating temperature at which the toner image is heated and a first standby temperature lower than the toner image heating temperature; a power supply unit for distributing power to the display unit and the fixing unit; and a control unit for causing the power supply unit to distribute power to the display unit and the fixing unit, wherein the control unit causes the power supply unit to distribute power to the fixing unit so that the fixing unit maintains a second standby temperature lower than the first standby temperature while causing the power supply unit to maintain the power distribution to the display unit when the detector unit does not detect the receipt of at least either one of the card insertion and the coin insertion by the vendor while detecting the connection of the vendor to the connection unit.

Generally, power consumption by the fixing unit to maintain the second standby temperature lower than the first standby temperature is lower than that by the fixing unit to maintain the standby temperature (first standby temperature) when the image forming apparatus is not performing any job.

According to this construction, the control unit causes the power supply unit to distribute power to the display unit and the fixing unit. This control unit causes the power supply unit to distribute power to the fixing unit so that the fixing unit maintains the second standby temperature lower than the first standby temperature while maintaining the power distribution to the display unit by the power supply unit, when the detector unit does not detect the receipt of at least either one of the card insertion and the coin insertion by the vendor while detecting the connection of the vendor.

In this way, when no card is inserted or no coins are inserted into the vendor connected to the image forming apparatus, the fixing unit maintains the second standby temperature lower than the first standby temperature while the power distribution to the display unit is maintained.

As a result, when being not used, this image forming apparatus can promote energy saving while maintaining the power distribution to the display unit.

Since power saving can be promoted while the power distribution to the display unit is maintained in this way, a message can be displayed to inform customers that the image forming apparatus is in a usable state with the power consumption reduced.

As a result, while the image forming apparatus is not used, it can be informed to customers that the image forming apparatus is in the usable state, and power saving can be promoted.

In the above construction, it is preferable that the control unit causes the power supply unit to distribute power to the fixing unit so that the fixing unit maintains the second standby temperature while maintaining the power distribution to the display unit by the power supply unit when the detector unit does not detect the receipt of at least either one of the card insertion and the coin insertion by the vendor while detecting the connection of the vendor to the connection unit, and causes the power supply unit to distribute power to the fixing unit so that the fixing unit maintains the first standby temperature while maintaining the power distribution to the display unit by the power supply unit when the detector unit detects the receipt of at least either one of the card insertion and the coin insertion by the vendor thereafter.

According to this construction, when the detector unit detects the receipt of at least either one of the card insertion and the coin insertion by the vendor after the temperature of the fixing unit is set to the second standby temperature, the temperature of the fixing unit is returned from the second standby temperature to the first standby temperature.

In this way, the receipt of at least either one of the card insertion and the coin insertion by the vendor triggers the return of the temperature of the fixing unit from the second standby temperature to the first standby temperature, whereby the temperature of the fixing unit rises to the first standby temperature.

As a result, the temperature of the fixing unit can return to the first standby temperature while a user inserts at least either a card or coins into the vendor and makes various settings such as a document size, a recording sheet size, a magnification, a density and the number of copies to be printed.

Accordingly, by the time when the user tries to start an operation for image formation after making the various settings, the temperature of the fixing unit can have returned to the first standby temperature. Thus, the user can immediately start the image formation on a recording sheet without waiting until the temperature of the fixing unit reaches the first standby temperature after the insertion of the card or coins into the vendor.

In the above construction, the control unit preferably executes an energy save mode for cutting off at least the power distribution to the fixing unit by the power supply unit or reducing at least the amount of power distributed to the fixing unit by the power supply unit while maintaining the power distribution to the display unit by the power supply unit, when the detector unit does not detect the receipt of at least either one of the card insertion and the coin insertion by the vendor while detecting the connection of the vendor to the connection unit.

According to this construction, the control unit causes the power supply unit to distribute power to the display unit and the fixing unit. This control unit executes the energy save mode for cutting off at least the power distribution to the fixing unit by the power supply unit or reducing at least the amount of power distributed to the fixing unit by the power supply unit while maintaining the power distribution to the display unit by the power supply unit, when the detector unit does not detect the receipt of at least either one of the card insertion and the coin insertion by the vendor while detecting the connection of the vendor.

Thus, when no card is inserted or no coins are inserted into the vendor connected to the image forming apparatus, power necessary to maintain the temperature of the fixing unit is reduced while the power distribution to the display unit is maintained.

As a result, when being not used, this image forming apparatus can promote power saving while maintaining the power distribution to the display unit.

Since power saving can be promoted while the power distribution to the display unit is maintained in this way, a message can be displayed to inform customers that the image forming apparatus is in the usable state with the power consumption reduced.

As a result, while the image forming apparatus is not used, it can be informed to customers that the image forming apparatus is in the usable state, and power saving can be promoted.

In the above construction, the control unit preferably causes the display unit to display a message screen requesting a user at least either to insert the card into the vendor or to insert coins into the vendor upon executing the energy save mode.

According to this construction, the message screen is displayed by the display unit to request the user at least either to insert the card into the vendor or to insert coins into the vendor when the energy save mode is executed.

As a result, the user can understand at a glance that it is sufficient for him at least either to insert the card or to insert coins into the vendor in order to bring the image forming apparatus to the usable state.

In the above construction, the control unit preferably ends the execution of the energy save mode and causes the power supply unit to distribute power to the fixing unit so that the fixing unit maintains the first standby temperature when the detector unit detects the receipt of at least either one of the card insertion and the coin insertion by the vendor while the energy save mode is executed.

According to this construction, the execution of the energy save mode is ended and the power supply unit is caused to distribute power to the fixing unit so that the fixing unit maintains the first standby temperature when the detector unit detects the receipt of at least either one of the card insertion and the coin insertion by the vendor while the energy save mode is executed.

In this way, the receipt of at least either one of the card insertion and the coin insertion by the vendor triggers the return of the temperature of the fixing unit to the first standby temperature, whereby the temperature of the fixing unit rises to the first standby temperature.

As a result, the temperature of the fixing unit can return to the first standby temperature while the user inserts at least the card or coins into the vendor and makes various settings such as a document size, a recording sheet size, a magnification, a density and the number of copies to be printed.

Accordingly, by the time when the user tries to start an operation for image formation after making the various settings, the temperature of the fixing unit can have returned to the first standby temperature. Thus, the user can immediately start the image formation on a recording sheet without waiting until the temperature of the fixing unit reaches the first standby temperature after the insertion of the card or coins into the vendor.

An image forming system according to another aspect of the present invention comprises a vendor capable of receiving at least either one of the insertion of a card recorded with usage information for the use of an image forming apparatus and coin insertion and adapted to output a reception signal indicating the receipt of at least either one of the card insertion and the coin insertion; and an image forming apparatus including a connection unit for outputting a connection notification signal notifying the connection of the vendor when the vendor for outputting the reception signal indicating the receipt of at least either one of the insertion of a card recorded with usage information for the use of the image forming apparatus and coin insertion is connected; a display unit; a detector unit for detecting the connection of the vendor to the connection unit upon receiving the connection notification signal output from the connection unit and detecting the receipt of at least either one of the card insertion and the coin insertion by the vendor upon receiving the reception signal output from the vendor via the connection unit; a fixing unit adapted to fix a toner image formed on a recording sheet by heating and pressing the toner image and capable of maintaining at least a toner image heating temperature at which the toner image is heated and a first standby temperature lower than the toner image heating temperature; a power supply unit for distributing power to the display unit and the fixing unit; and a control unit for causing the power supply unit to distribute power to the display unit and the fixing unit, wherein the control unit causes the power supply unit to distribute power to the fixing unit so that the fixing unit maintains a second standby temperature lower than the first standby temperature while causing the power supply unit to maintain the power distribution to the display unit when the detector unit does not detect the receipt of at least either one of the card insertion and the coin insertion by the vendor while detecting the connection of the vendor to the connection unit.

According to this construction, the control unit causes the power supply unit to distribute power to the display unit and the fixing unit. This control unit causes the power supply unit to distribute power to the fixing unit so that the fixing unit maintains the second standby temperature lower than the first standby temperature while maintaining the power distribution to the display unit by the power supply unit, when the detector unit does not detect the receipt of at least either one of the card insertion and the coin insertion by the vendor while detecting the connection of the vendor.

In this way, when no card is inserted or no coins are inserted into the vendor connected to the image forming apparatus, the fixing unit maintains the second standby temperature lower than the first standby temperature while the power distribution to the display unit is maintained.

As a result, when being not used, this image forming apparatus can promote energy saving while maintaining the power distribution to the display unit.

Since power saving can be promoted while the power distribution to the display unit is maintained in this way, a message can be displayed to inform customers that the image forming apparatus is in a usable state with the power consumption reduced.

As a result, while the image forming apparatus is not used, it can be informed to customers that the image forming apparatus is in the usable state, and power saving can be promoted.

In the above construction, it is preferable that the control unit of the image forming apparatus causes the power supply unit to distribute power to the fixing unit so that the fixing unit maintains the second standby temperature while maintaining the power distribution to the display unit by the power supply unit when the detector unit does not detect the receipt of at least either one of the card insertion and the coin insertion by the vendor while detecting the connection of the vendor to the connection unit, and causes the power supply unit to distribute power to the fixing unit so that the fixing unit maintains the first standby temperature while maintaining the power distribution to the display unit by the power supply unit when the detector unit detects the receipt of at least either one of the card insertion and the coin insertion by the vendor thereafter.

According to this construction, when the detector unit detects the receipt of at least either one of the card insertion and the coin insertion by the vendor after the temperature of the fixing unit is set to the second standby temperature, the temperature of the fixing unit is returned from the second standby temperature to the first standby temperature.

In this way, the receipt of at least either one of the card insertion and the coin insertion by the vendor triggers the return of the temperature of the fixing unit from the second standby temperature to the first standby temperature, whereby the temperature of the fixing unit rises to the first standby temperature.

As a result, the temperature of the fixing unit can return to the first standby temperature while a user inserts at least either a card or coins into the vendor and makes various settings such as a document size, a recording sheet size, a magnification, a density and the number of copies to be printed.

Accordingly, by the time when the user tries to start an operation for image formation after making the various settings, the temperature of the fixing unit can have returned to the first standby temperature. Thus, the user can immediately start the image formation on a recording sheet without waiting until the temperature of the fixing unit reaches the first standby temperature after the insertion of the card or coins into the vendor.

In the above construction, it is preferable that the control unit of the image forming apparatus executes an energy save mode for cutting off at least the power distribution to the fixing unit by the power supply unit or reducing at least the amount of power distributed to the fixing unit by the power supply unit while maintaining the power distribution to the display unit by the power supply unit, when the detector unit does not detect the receipt of at least either one of the card insertion and the coin insertion by the vendor while detecting the connection of the vendor to the connection unit.

According to this construction, the control unit causes the power supply unit to distribute power to the display unit and the fixing unit. This control unit executes the energy save mode for cutting off at least the power distribution to the fixing unit by the power supply unit or reducing at least the amount of power distributed to the fixing unit by the power supply unit while maintaining the power distribution to the display unit by the power supply unit, when the detector unit does not detect the receipt of at least either one of the card insertion and the coin insertion by the vendor while detecting the connection of the vendor.

Thus, when no card is inserted or no coins are inserted into the vendor connected to the image forming apparatus, power necessary to maintain the temperature of the fixing unit is reduced while the power distribution to the display unit is maintained.

As a result, when being not used, this image forming apparatus can promote power saving while maintaining the power distribution to the display unit.

Since power saving can be promoted while the power distribution to the display unit is maintained in this way, a message can be displayed to inform customers that the image forming apparatus is in the usable state with the power consumption reduced.

As a result, while the image forming apparatus is not used, it can be informed to customers that the image forming apparatus is in the usable state, and power saving can be promoted.

In the above construction, the control unit of the image forming apparatus preferably causes the display unit to display a message screen requesting a user at least either to insert the card into the vendor or to insert coins into the vendor upon executing the energy save mode.

According to this construction, the message screen is displayed by the display unit to request the user at least either to insert the card into the vendor or to insert coins into the vendor when the energy save mode is executed.

As a result, the user can understand at a glance that it is sufficient for him at least either to insert the card or to insert coins into the vendor in order to bring the image forming apparatus to the usable state.

In the above construction, the control unit preferably ends the execution of the energy save mode and causes the power supply unit to distribute power to the fixing unit so that the fixing unit maintains the first standby temperature when the detector unit detects the receipt of at least either one of the card insertion and the coin insertion by the vendor while the energy save mode is executed.

According to this construction, the execution of the energy save mode is ended and the power supply unit is caused to distribute power to the fixing unit so that the fixing unit maintains the first standby temperature when the detector unit detects the receipt of at least either one of the card insertion and the coin insertion by the vendor while the energy save mode is executed.

In this way, the receipt of at least either one of the card insertion and the coin insertion by the vendor triggers the return of the temperature of the fixing unit to the first standby temperature, whereby the temperature of the fixing unit rises to the first standby temperature.

As a result, the temperature of the fixing unit can return to the first standby temperature while the user inserts at least the card or coins into the vendor and makes various settings such as a document size, a recording sheet size, a magnification, a density and the number of copies to be printed.

Accordingly, by the time when the user tries to start an operation for image formation after making the various settings, the temperature of the fixing unit can have returned to the first standby temperature. Thus, the user can immediately start the image formation on a recording sheet without waiting until the temperature of the fixing unit reaches the first standby temperature after the insertion of the card or coins into the vendor.

A method for controlling power distribution of an image forming apparatus according to still another aspect of the present invention comprises a first power distribution control step of distributing power at least to a display unit and a fixing unit for fixing a toner image formed on a recording sheet by heating and pressing the toner image, so that the fixing unit maintains a first standby temperature lower than a toner image heating temperature at which the toner image formed on the recording sheet is heated; a first judgment step of judging whether or not a vendor for receiving at least either one of the insertion of a card recorded with usage information for the use of the image forming apparatus and coin insertion is connected; a second judgment step of judging whether or not the vendor has received at least either one of the card insertion and the coin insertion; and a second power distribution control step of distributing power to the fixing unit so that the fixing unit maintains a second standby temperature lower than the first standby temperature while maintaining the power distribution to the display unit in the power distributing state in the first power distribution control step if the vendor has received neither the card insertion nor the coin insertion while being connected to the image forming apparatus.

According to this method, in the first power distribution control step, power is distributed to the display unit and also to the fixing unit so that the fixing unit maintains the first standby temperature. In this state, the second power distribution control step is performed if it is judged in the first and second judgment steps that the vendor has received neither the card insertion nor the coin insertion although the vendor is connected to the image forming apparatus.

This second power distribution control step is performed to distribute power to the fixing unit so that the fixing unit maintains the second standby temperature lower than the first standby temperature while the power distribution to the display unit is maintained in the power distributing state in the first power distribution control step.

In this way, the fixing unit maintains the second standby temperature lower than the first standby temperature while the power distribution to the display unit is maintained in the power distributing state in the first power distribution control step when no card is inserted or no coins are inserted into the vendor connected to the image forming apparatus.

As a result, when being not used, this image forming apparatus can promote energy saving while maintaining the power distribution to the display unit in the power distributing state in the first power distribution control step.

Since power saving can be promoted while the power distribution to the display unit is maintained in the power distributing state in the first power distribution control step in this way, a message can be displayed to inform customers that the image forming apparatus is in a usable state with the power consumption reduced.

As a result, while the image forming apparatus is not used, it can be informed to customers that the image forming apparatus is in the usable state, and power saving can be promoted.

In the above method, in the second power distribution control step, an energy save mode for cutting off at least the power distribution to the fixing unit or reducing at least the amount of power distributed to the fixing unit is preferably executed while the power distribution to the display unit is maintained in the power distributing state in the first power distribution control step.

According to this method, in the second power distribution control step, the energy save move for cutting off at least the power distribution to the fixing unit or reducing at least the amount of power distributed to the fixing unit is executed while the power distribution to the display unit is maintained in the power distributing state in the first power distribution control step.

In this way, power necessary to maintain the temperature of the fixing unit is reduced while the power distribution to the display unit is maintained in the power distributing state in the first power distribution control step when no card is inserted or no coins are inserted into the vendor connected to the image forming apparatus.

As a result, when being not used, this image forming apparatus can promote energy saving while maintaining the power distributing state to the display unit in the first power distribution control step.

Since power saving can be promoted while the power distributing state to the display unit in the first power distribution control step is maintained in this way, a message can be displayed to inform customers that the image forming apparatus is in a usable state with the power consumption reduced.

As a result, while the image forming apparatus is not used, it can be informed to customers that the image forming apparatus is in the usable state, and power saving can be promoted.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds are therefore intended to be embraced by the claims.

This application is based on Japanese Patent Application Serial No. 2008-289953, filed in Japan Patent Office on Nov. 12, 2008, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. An image forming apparatus, comprising:

a connection unit for outputting a connection notification signal notifying the connection of a vendor when the vendor for outputting a reception signal indicating the receipt of at least either one of the insertion of a card recorded with usage information for the use of the image forming apparatus and coin insertion is connected;

a display unit;

a detector unit for detecting the connection of the vendor to the connection unit upon receiving the connection notification signal output from the connection unit and detecting the receipt of at least either one of the card insertion and the coin insertion by the vendor upon receiving the reception signal output from the vendor via the connection unit;

a fixing unit adapted to fix a toner image formed on a recording sheet by heating and pressing the toner image and capable of maintaining at least a toner image heating temperature at which the toner image is heated and a first standby temperature lower than the toner image heating temperature;

a power supply unit for distributing power to the display unit and the fixing unit; and a control unit for causing the power supply unit to distribute power to the display unit and the fixing unit, wherein the control unit:

causes the power supply unit to distribute power to the fixing unit so that the fixing unit maintains a second standby temperature lower than the first standby temperature while causing the power supply unit to maintain the power distribution to the display unit when the detector unit does not detect the receipt of at least either one of the card insertion and the coin insertion by the vendor while detecting the connection of the vendor to the connection unit, and causes the power supply unit to distribute power to the fixing unit so that the fixing unit maintains the first standby temperature while maintaining the power distribution to the display unit by the power supply unit when the detector unit detects the receipt of at least either one of the card insertion and the coin insertion by the vendor thereafter.

2. An image forming apparatus, comprising:

a connection unit for outputting a connection notification signal notifying the connection of a vendor when the vendor for outputting a reception signal indicating the receipt of at least either one of the insertion of a card recorded with usage information for the use of the image forming apparatus and coin insertion is connected;

a display unit;

a detector unit for detecting the connection of the vendor to the connection unit upon receiving the connection notification signal output from the connection unit and detecting the receipt of at least either one of the card insertion and the coin insertion by the vendor upon receiving the reception signal output from the vendor via the connection unit;

a fixing unit adapted to fix a toner image formed on a recording sheet by heating and pressing the toner image and capable of maintaining at least a toner image heating temperature at which the toner image is heated and a first standby temperature lower than the toner image heating temperature;

a power supply unit for distributing power to the display unit and the fixing unit; and a control unit for causing the power supply unit to distribute power to the display unit and the fixing unit, wherein the control unit:

executes an energy save mode for cutting off at least the power distribution to the fixing unit by the power supply unit or reducing at least the amount of power distributed to the fixing unit by the power supply unit while maintaining the power distribution to the display unit by the power supply unit, when the detector unit does not detect the receipt of at least either one of the card insertion and the coin insertion by the vendor while detecting the connection of the vendor to the connection unit, and causes the display unit to display a message screen requesting a user at least either to insert the card into the vendor or to insert coins into the vendor upon executing the energy save mode.

3. An image forming apparatus according to claim 2 wherein the control unit ends the execution of the energy save mode and causes the power supply unit to distribute power to the fixing unit so that the fixing unit maintains the first standby temperature when the detector unit detects the receipt of at least either one of the card insertion and the coin insertion by the vendor while the energy save mode is executed.

4. An image forming system, comprising:

a vendor capable of receiving at least either one of the insertion of a card recorded with usage information for the use of an image forming apparatus and coin insertion and adapted to output a reception signal indicating the receipt of at least either one of the card insertion and the coin insertion; and an image forming apparatus including:

a connection unit for outputting a connection notification signal notifying the connection of the vendor when the vendor for outputting the reception signal indicating the receipt of at least either one of the insertion of a card recorded with usage information for the use of the image forming apparatus and coin insertion is connected;

a display unit;

a detector unit for detecting the connection of the vendor to the connection unit upon receiving the connection notification signal output from the connection unit and detecting the receipt of at least either one of the card insertion and the coin insertion by the vendor upon receiving the reception signal output from the vendor via the connection unit;

a fixing unit adapted to fix a toner image formed on a recording sheet by heating and pressing the toner image and capable of maintaining at least a toner image heating temperature at which the toner image is heated and a first standby temperature lower than the toner image heating temperature;

a power supply unit for distributing power to the display unit and the fixing unit; and a control unit for causing the power supply unit to distribute power to the display unit and the fixing unit, wherein the control unit:

causes the power supply unit to distribute power to the fixing unit so that the fixing unit maintains a second standby temperature lower than the first standby temperature while causing the power supply unit to maintain the power distribution to the display unit when the detector unit does not detect the receipt of at least either one of the card insertion and the coin insertion by the vendor while detecting the connection of the vendor to the connection unit, and causes the power supply unit to distribute power to the fixing unit so that the fixing unit maintains the first standby temperature while maintaining the power distribution to the display unit by the power supply unit when the detector unit detects the receipt of at least either one of the card insertion and the coin insertion by the vendor thereafter.

5. An image forming system, comprising:

a vendor capable of receiving at least either one of the insertion of a card recorded with usage information for the use of an image forming apparatus and coin insertion and adapted to output a reception signal indicating the receipt of at least either one of the card insertion and the coin insertion; and an image forming apparatus including:

a connection unit for outputting a connection notification signal notifying the connection of the vendor when the vendor for outputting the reception signal indicating the receipt of at least either one of the insertion of a card recorded with usage information for the use of the image forming apparatus and coin insertion is connected;

a display unit;

a detector unit for detecting the connection of the vendor to the connection unit upon receiving the connection notification signal output from the connection unit and detecting the receipt of at least either one of the card insertion and the coin insertion by the vendor upon receiving the reception signal output from the vendor via the connection unit;

a fixing unit adapted to fix a toner image formed on a recording sheet by heating and pressing the toner image and capable of maintaining at least a toner image heating temperature at which the toner image is heated and a first standby temperature lower than the toner image heating temperature;

a power supply unit for distributing power to the display unit and the fixing unit; and a control unit for causing the power supply unit to distribute power to the display unit and the fixing unit, wherein the control unit of the image forming apparatus:

executes an energy save mode for cutting off at least the power distribution to the fixing unit by the power supply unit or reducing at least the amount of power distributed to the fixing unit by the power supply unit while maintaining the power distribution to the display unit by the power supply unit, when the detector unit does not detect the receipt of at least either one of the card insertion and the coin insertion by the vendor while detecting the connection of the vendor to the connection unit, and causes the display unit to display a message screen requesting a user at least either to insert the card into the vendor or to insert coins into the vendor upon executing the energy save mode.

6. An image forming system according to claim 5, wherein the control unit of the image forming apparatus ends the execution of the energy save mode and causes the power supply unit to distribute power to the fixing unit so that the fixing unit maintains the first standby temperature when the detector unit detects the receipt of at least either one of the card insertion and the coin insertion by the vendor while the energy save mode is executed.

7. A method for controlling power distribution of an image forming apparatus, comprising:

a first power distribution control step of distributing power at least to a display unit and a fixing unit for fixing a toner image formed on a recording sheet by heating and pressing the toner image, so that the fixing unit maintains a first standby temperature lower than a toner image heating temperature at which the toner image formed on the recording sheet is heated;

a first judgment step of judging whether or not a vendor for receiving at least either one of the insertion of a card recorded with usage information for the use of the image forming apparatus and coin insertion is connected;

a second judgment step of judging whether or not the vendor has received at least either one of the card insertion and the coin insertion;

a power distribution step of distributing power to the fixing unit so that the fixing unit maintains the first standby temperature in a case where the vendor is not connected to the image forming apparatus; and a second power distribution control step of distributing power to the fixing unit so that the fixing unit maintains a second standby temperature lower than the first standby temperature while maintaining the power distribution to the display unit in the power distributing state in the first power distribution control step if the vendor has received neither the card insertion nor the coin insertion while being connected to the image forming apparatus.

8. A method according to claim 7, wherein, in the second power distribution control step, an energy save mode for cutting off at least the power distribution to the fixing unit or reducing at least the amount of power distributed to the fixing unit is executed instead of distributing power to the fixing unit so that the fixing unit maintains the second standby temperature lower than the first standby temperature.

9. An image forming apparatus, comprising:

a connection unit for outputting a connection notification signal notifying the connection of a vendor when the vendor for outputting a reception signal indicating the receipt of at least either one of the insertion of a card recorded with usage information for the use of the image forming apparatus and coin insertion is connected;

a display unit;

a detector unit for detecting the connection of the vendor to the connection unit upon receiving the connection notification signal output from the connection unit and detecting the receipt of at least either one of the card insertion and the coin insertion by the vendor upon receiving the reception signal output from the vendor via the connection unit;

a fixing unit adapted to fix a toner image formed on a recording sheet by heating and pressing the toner image and capable of maintaining at least a toner image heating temperature at which the toner image is heated and a first standby temperature lower than the toner image heating temperature;

a power supply unit for distributing power to the display unit and the fixing unit; and a control unit for causing the power supply unit to distribute power to the display unit and the fixing unit, wherein the control unit:

causes the power supply unit to distribute power to the fixing unit so that the fixing unit maintains the first standby temperature unless the detector unit detects the connection of the vendor to the connection unit; and causes the power supply unit to distribute power to the fixing unit so that the fixing unit maintains a second standby temperature lower than the first standby temperature while causing the power supply unit to maintain the power distribution to the display unit when the detector unit does not detect the receipt of at least either one of the card insertion and the coin insertion by the vendor while detecting the connection of the vendor to the connection unit.

10. An image forming apparatus according to claim 9, wherein the control unit causes the power supply unit to distribute power to the fixing unit so that the fixing unit maintains the second standby temperature while maintaining the power distribution to the display unit by the power supply unit when the detector unit does not detect the receipt of at least either one of the card insertion and the coin insertion by the vendor while detecting the connection of the vendor to the connection unit, and causes the power supply unit to distribute power to the fixing unit so that the fixing unit maintains the first standby temperature while maintaining the power distribution to the display unit by the power supply unit when the detector unit detects the receipt of at least either one of the card insertion and the coin insertion by the vendor thereafter.

11. An image forming apparatus according to claim 9, wherein the control unit executes an energy save mode for cutting off at least the power distribution to the fixing unit by the power supply unit or reducing at least the amount of power distributed to the fixing unit by the power supply unit instead of distributing power to the fixing unit so that the fixing unit maintains the second standby temperature lower than the first standby temperature.

12. An image forming apparatus according to claim 11, wherein the control unit causes the display unit to display a message screen requesting a user at least either to insert the card into the vendor or to insert coins into the vendor upon executing the energy save mode.

13. An image forming apparatus according to claim 11, wherein the control unit ends the execution of the energy save mode and causes the power supply unit to distribute power to the fixing unit so that the fixing unit maintains the first standby temperature when the detector unit detects the receipt of at least either one of the card insertion and the coin insertion by the vendor while the energy save mode is executed.

* * * * *